United States Patent [19]

Freilich

[11] Patent Number: 4,878,364

[45] Date of Patent: Nov. 7, 1989

[54] DOUBLE FACED JEWELRY SETTING

[75] Inventor: Joseph A. Freilich, Jericho, N.Y.

[73] Assignee: M. Fabrikant & Sons, Inc., New York, N.Y.

[21] Appl. No.: 198,592

[22] Filed: May 19, 1988

Related U.S. Application Data

[63] Continuation-in-part of Ser. No. 72,664, Jul. 13, 1987, abandoned.

[51] Int. Cl.[4] ..... A44C 27/00; A44C 17/02

[52] U.S. Cl. ..... 63/28; 63/2; 29/10

[58] Field of Search ..... 63/26, 28, 29 R, 2; 29/160.6, 10

[56] References Cited

U.S. PATENT DOCUMENTS

| | | | |
|---|---|---|---|
| 221,041 | 10/1879 | Droper | 63/26 |
| 260,088 | 6/1882 | Dolloff | 63/23 |
| 1,001,377 | 8/1911 | Fairbrother | 63/28 |
| 1,567,516 | 12/1925 | Kirchner | 63/26 |
| 1,894,195 | 1/1933 | Pulver | 63/28 |
| 2,774,231 | 12/1956 | Peterson | 63/28 |

*Primary Examiner*—Richard J. Johnson
*Attorney, Agent, or Firm*—Peter L. Berger

[57] ABSTRACT

A double face jewelry setting includes a base formed by a first base section and a second base section in parallel, spaced relation to said first base section, each base section including a plurality of through bores for holding a plurality of gemstones on first and second sides of the base, such that the bores of the first base section are in alignment with the bores of the second base section; and a plurality of posts extending along the inner and outer edges of the first and second base sections for securing a plurality of first gemstones on the first base section in at least a substantially abutting relation and for securing a plurality of second gemstones on the second base section in at least a substantially abutting relation, the posts being bendable to retain the gemstones thereon; and each pair of adjacent gemstones on each base section are retained on the base section by a common one of the posts; such that different gemstones can be retained and displayed on the first and second opposite sides of the base.

16 Claims, 2 Drawing Sheets

FIG. 3
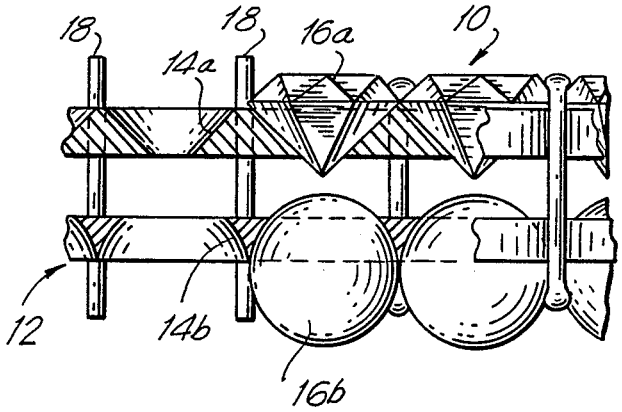
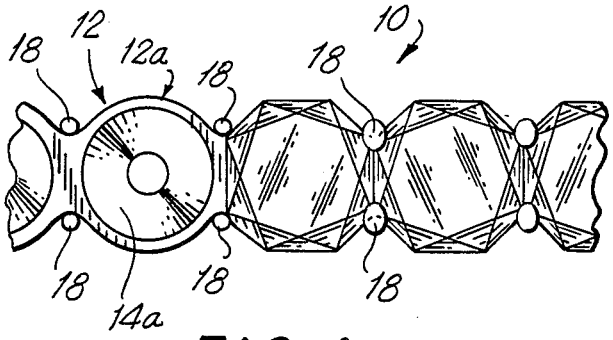
FIG. 4

DOUBLE FACED JEWELRY SETTING

REFERENCE TO RELATED APPLICATION

The present application is a Continuation-In-Part of U.S. patent application Ser. No. 07/072,664, filed July 13, 1987, abandoned to Joseph A. Freilich, and entitled "DOUBLE FACE JEWELRY SETTING".

BACKGROUND OF THE INVENTION

This invention relates generally to jewelry, and more particularly, is directed to a jewelry setting in which different gemstones are capable of being mounted on opposite sides thereof in the same pattern for providing two different aesthetic appearances.

It is known to create a first jewelry article containing a plurality of gemstones of a first type in a particular pattern, and to create a second jewelry article containing a plurality of gemstones of a second type in the same pattern. For example, a heart shaped locket may contain a plurality of diamonds in a particular pattern, and a different locket with the same heart shape may contain a plurality of rubies in the same pattern. This requires additional manufacturing costs since two different jewelry articles must be produced, with the resultant cost being borne by the consumer.

Further, double face jewelry articles are known, for example, from U.S. Pat. No. 1,894,195, which discloses an ornamental bead chain having diamonds positioned on opposite sides thereof. Specifically, the diamonds are set in V-shaped grooves. Thus, the diamonds fit in grooves in a staggered relation. As such, the chain is only intended to retain the same type of gemstone, that is, a diamond, on each side. It is therefore difficult to provide the same pattern on both sides of the chain with different gemstones on each side of the chain. Further, it may be somewhat expensive and difficult to manufacture the chain of this U.S. patent. In addition, because of the spacing between the diamonds on each side, the diamonds on the other side are always generally visible, thereby detracting from the aesthetic appearance.

U.S. Pat. No. 221,041 discloses a gem setting plate which allows gems to be set on opposite sides of the plate. The plate carries a loop in its top portion which is attachable to a chain or the like, and the plate serves as a charm with the gems attachable on opposite sides of the charm. There is a significant border area around each of the gems on each side, and there is no showing nor suggestion for providing a structure to secure each gem on each side in substantially abutting relation to the adjoining gem. In fact, if one were to attempt to use the Draper system to attach a plurality of adjoining plates to from a jewelry structure, one would find individual plates which would have to be soldered together and which would have adjoining border areas between the adjacent plates. This is specifically avoided in the present invention in which the double faced jewelry setting allows for the gems on each side of the jewelry item to be in substantially abutting relation which provides an improved effect sought with this invention.

Other U.S. patents which may be relevant to the present invention are U.S. Pat. Nos. 260,088; 758,847; 899,516; 1,001,377; 1,308,011; and U.S. Design Pat. Nos. 70,990 and 273,371.

Further, with known arrangements, each gem is secured to the jewelry article by securing means which is different from the securing means for any other gemstone. This results in a waste of material and an increase in the time needed to assemble the gems to the jewelry article.

OBJECTS AND SUMMARY OF THE INVENTION

Accordingly, it is an object of the present invention to provide a double face jewelry setting that overcomes the aforementioned disadvantages in the prior art.

It is another object of the present invention to provide a double face jewelry setting that provides two opposite sides with different gemstones secured thereon in the same pattern.

It is still another object of the present invention to provide such a double face jewelry setting in which the gemstones on each side are adjacent to each other in at least a substantially abutting relation.

It is yet another object of the present invention to provide such a double face jewelry setting in which the gemstones on one side are in alignment with the gemstones on the opposite side.

It is a further object of the present invention to provide such a double face jewelry setting in which a single post of each gem securing means is used to secure two adjacent, at least substantially abutting gemstones to the jewelry setting.

It is a still further object of the present invention to provide a double face jewelry setting that provides a two-in-one jewelry article at reduced manufacturing cost.

It is a yet further object of the present invention to provide a double face jewelry setting having great aesthetic appeal.

In accordance with an aspect of the present invention, a double face jewelry setting includes a base having first and second opposite sides; and securing means for securing a plurality of first gemstones on the first side in at least a substantially abutting relation and for securing a plurality of second gemstones on the second side in at least a substantially abutting relation, wherein different gemstones can be retained and displayed on the first and second opposite sides.

In accordance with another aspect of the present invention, a double face jewelry setting includes a base having first and second opposite sides; posts extending along inner and outer edges of the base for securing a plurality of first gemstones on the first side and for securing a plurality of second gemstones on the second side, the posts being bendable to retain the gemstones on the first and second sides; and at least two gemstones on one of the sides are retained on the base by a common one of the posts; wherein different gemstones can be retained and displayed on the first and second opposite sides.

The above and other objects, features and advantages of the present invention will become readily apparent from the following detailed description which is to be read in connection with the accompanying drawings.

BRIEF DESCRIPTION OF THE DRAWINGS

FIG. 3 is an enlarged cross-sectional view of a portion of the double face jewelry setting of FIG. 2, taken along line 3—3 thereof; and FIG. 4 is an enlarged top plan view of a portion of the double face jewelry setting of FIG. 2.

DETAILED DESCRIPTION OF THE PREFERRED EMBODIMENTS

Figure 2:
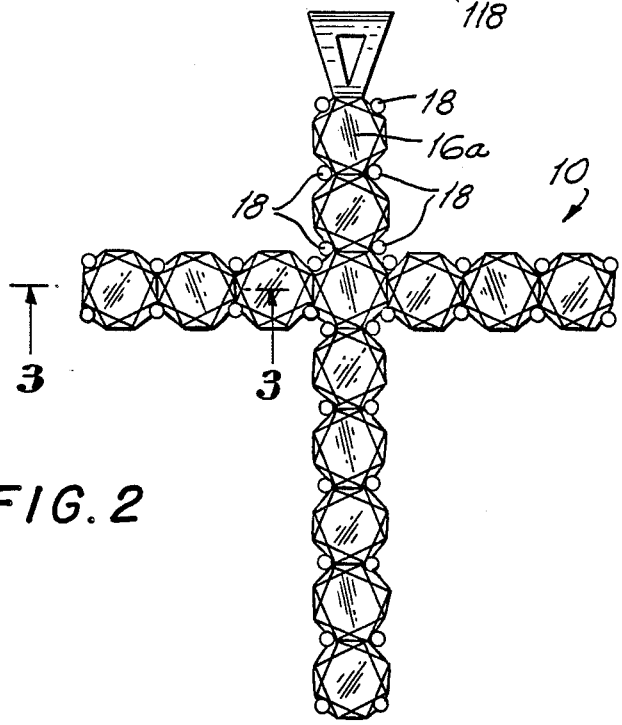
FIG. 2 is a top plan view of a cross-shaped pendant according to a second embodiment of the present invention.

Referring to the drawings in detail, and initially to FIGS. 2–4 thereof, a double face jewelry setting 10 in accordance with one embodiment of the present invention is in the form of a cross-shaped pendant and includes a support base 12 which may be rigid, semi-rigid, or flexible, and is preferably made of a metal material. Support base 12 can take any suitable form for mounting gemstones thereon, as will be apparent from the specific example which follows.

Specifically, as shown in FIG. 3, support base 12 preferably includes a first base section **12*a* and a second base section 12*b* which are generally arranged in parallel, spaced relation. First base section 12*a* includes a plurality of gem receiving through bores 14*a* therein in spaced relation therealong. In the embodiment of FIG. 3, each gem receiving through bore 14*a* has a truncated frustoconical configuration for receiving a faceted gemstone 16*a*, such as a diamond, ruby, sapphire or the like. In like manner, second base section 12*b* includes a plurality of gem receiving through bores 14*b* therein in spaced relation therealong. In the embodiment of FIG. 3, each gem receiving through bore 14*b* has an arcuate, part-spherical configuration for receiving a spherical gemstone 16*b***, such as a pearl, colored stone or the like.

It is important from the standpoint of the present invention that bores **14*a* are spaced from each other by a distance so that gemstones 16*a* are in at least substantially abutting relation, and are preferably in contact with each other. In like manner, it is important that bores 14*b* are spaced from each other by a distance so that gemstones 16*b* are in at least substantially abutting relation, and are preferably in contact with each other. In addition, and related to this aspect of the present invention, it is important that bores 14*a* and 14*b*, and therefore, gemstones 16*a* and 16*b*, are in alignment with each other. Therefore, since there is substantially no space between adjacent gemstones, and since gemstones 16*a* and 16*b* are in alignment with each other, the jewelry setting 10 according to the present invention can be used with either side facing outwardly, with the gemstones on the non-facing side being substantially hidden and thereby not affecting the visual appearance of the outwardly facing side. Thus, with the above example, jewelry setting 10 can be used with the diamond gemstones 16*a* facing outwardly or the pearl gemstones 16*b*** facing outwardly.

In accordance with an important aspect of the present invention, a plurality of posts 18 extend substantially perpendicular to first base section **12*a* and to second base section 12*b*, and are secured to the inner and outer edges of both sections 12*a* and 12*b* by welding or the like, so as to connect base sections 12*a* and 12*b*** together in the aforementioned parallel, spaced apart relation, as best shown in FIGS. 3 and 4.

Each post 18 is displaced to one edge of base sections **12*a* and 12*b* and secured to base sections 12*a* and 12*b* thereat, and is positioned at the respective edge between adjacent gemstones 16*a* and 16*b*. Posts 18 are bendable, as will be apparent from the description which follows, and are spaced apart a predetermined distance from each other. Thus, when the opposite ends of each post 18 are bent inwardly, the bent ends engage two abutting, or substantially abutting, gemstones. For example, when the upper end of a post 18 in FIG. 3 is bent inwardly, it engages two adjacent, abutting gemstones 16*a*, and when the lower end of the same post 18 is bent inwardly, it engages two adjacent, abutting gemstones 16*b*. The posts 18 are arranged at both edges of base sections 12*a* and 12*b*. Accordingly, as best shown in FIG. 4, each gemstone 16*a* (and 16*b*) is held by four posts 18, with each post 18** engaging two adjacent gemstones.

Of course, it will be appreciated that various modifications can be to the above arrangement. For example, base sections **12*a* and 12*b* can be secured by any other suitable means in such parallel, spaced apart relation, rather than by posts 18. In such case, posts 18 would still be provided for securing gemstones 16*a* and 16*b* on base sections 12*a* and 12*b*, respectively. Still further, instead of using a single post 18, two posts can be used in place thereof, one for each base section 12*a* and 12*b*, with the posts used for securing gemstones 16*a* being in alignment with the posts used for securing gemstones 16*b***.

Thus, with the present invention, the wearer can present a different aesthetic appearance with the same pattern, in a single article of jewelry. Therefore, the gemstones on one side will not affect the appearance of the gemstones on the opposite side. Further, the use of a common post for securing adjacent gemstones **16*a* on one side and for securing adjacent gemstones 16*b*** on the opposite side provides for easy and economical manufacturing, while producing two different appearances for the single jewelry article.

Although the present invention has been described with respect to the cross-shaped pendant 10 of FIGS. 2–4, it will be appreciated that different shaped jewelry settings can be used. For example, there is shown a heartshaped pendant 110 in FIG. 1 in accordance with another embodiment of the present invention, in which elements corresponding to those in the embodiment of FIGS. 2–4 are identified by the same reference numerals, augmented by 100, and a detailed description thereof will be omitted for the sake of brevity.

Figure 1:
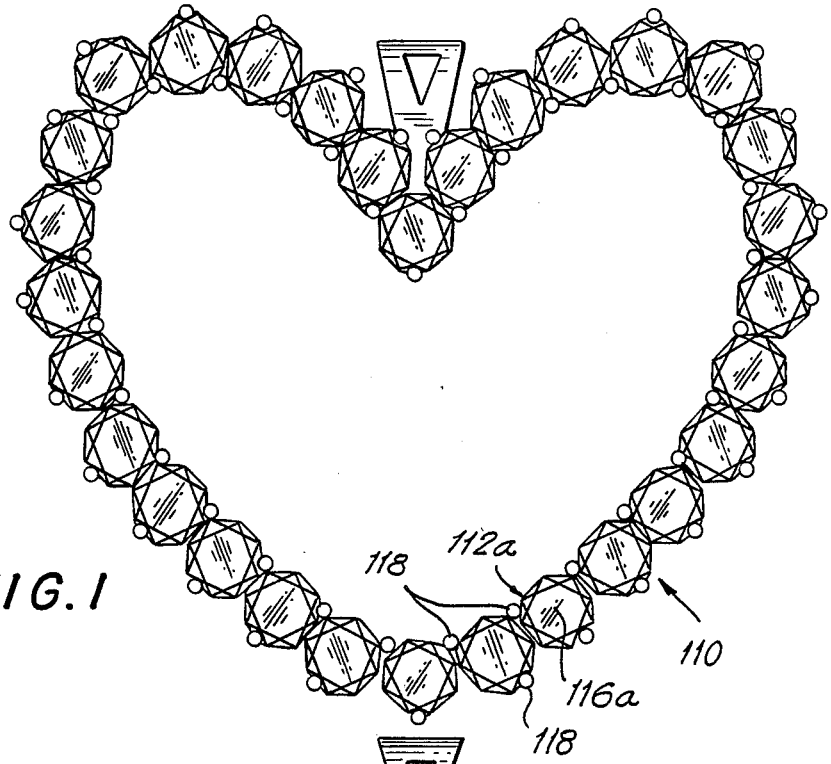
FIG. 1 is a top plan view of a heart-shaped pendant according to a first embodiment of the present invention.

As shown, posts 118 are arranged in a triangular configuration around each gemstone **116*a*, the gemstone in this instance being a diamond. With gemstones 116*a* placed between each triad of posts 118, the posts 118 are then bent inwardly over gemstones 116*a*, to retain them on first base section 112*a*. Specifically, as shown in FIG. 1, the posts 118 along the inner edge of base section 112*a* are each positioned between two abutting, or substantially abutting, gemstones 116*a*, whereby each inner post 118 engages and secures two adjacent gemstones 116*a*. On the other hand, the posts 118 along the outer edge of base section 112*a* engage and secure only one gemstone 116*a***. However, the embodiment of FIG. 1 provides the same advantages as the embodiment of FIGS. 2–4.

In addition, it will be appreciated that heart-shaped pendant 110 includes a second base section (not shown) in parallel, spaced relation to first base section **112*a*, for securing a second set of gemstones on the opposite side of pendant 110**, in the same manner as shown in FIG. 3.

Having described specific preferred embodiments of the invention with reference to the accompanying drawings, it will be appreciated that the present invention is not limited to those precise embodiments, and that various changes and modifications may be effected therein by one of ordinary skill in the art without departing from the scope or spirit of the invention as defined in the appended claims.

What is claimed is:

1. A double faced jewelry setting comprising:

a base having first and second opposite sides;

securing means for securing a plurality of first gemstones on said first side in at least a substantially abutting relation and for securing a plurality of second gemstones on said second side in at least a substantially abutting relation, wherein different gemstones can be retained and displayed on the first and second opposite sides, said base including a first base section for holding said plurality of first gemstones and a second base section for holding said plurality of second gemstones, said first and second base sections being substantially parallel to each other in a spaced apart relation, said first base section including a plurality of first bores for holding said plurality of first gemstones and said second base section including a plurality of second bores for holding said plurality of second gemstones, wherein said first and second bores are in alignment with each other.

2. A double face jewelry setting according to claim 1, wherein said securing means secures said first gemstones on said first side in substantial alignment with said second gemstones on said second side.

3. A double face jewelry setting according to claim 1, wherein said base is in the shape of a cross.

4. A double face jewelry setting according to claim 1, wherein said base is in the shape of a heart.

5. A double face jewelry setting according to claim 1, wherein at least one of said first and second bores has a configuration selected from the group consisting of a truncated frusto-conical configuration and a part-spherical configuration.

6. A double face jewelry setting according to claim 1, wherein said securing means includes posts extending along inner and outer edges of said base for securing said first gemstones and said second gemstones to said first and second base sections, respectively, and each of a plurality of said posts extends between two adjacent gemstones and is bent over in contact with said two adjacent gemstones for securing said two adjacent gemstones on a respective base section.

7. A double face jewelry setting according to claim 6, wherein each post of said plurality of posts has a first end for securing two adjacent gemstones on said first base section and a second opposite end for securing two adjacent gemstones on said second base section.

8. A double faced jewelry setting comprising:

a base having first and second opposite sides;

securing means for securing a plurality of first gemstones on said first side in at least a substantially abutting relation and for securing a plurality of second gemstones on said second side in at least a substantially abutting relation, wherein different gemstones can be retained and displayed on the first and second opposite sides, said securing means including posts extending along inner and outer edges of said base for securing said first gemstones and said second gemstones to said first and second sides of said base, respectively, and each of a plurality of said posts extends between two adjacent gemstones and is bent over in contact with said two adjacent gemstones for securing said two adjacent gemstones on a respective side of said base.

9. A double faced jewelry setting comprising:

a base having first and second opposite sides;

posts extending along inner and outer edges of said base for securing a plurality of first gemstones on said first side and for securing a plurality of second gemstones on said second side, said posts being bendable to retain the gemstones thereon;

at least two gemstones on one of said sides are retained on said base by a common one of said posts;

wherein different gemstones can be retained and displayed on the first and second opposite sides, said base including a first base section for holding said plurality of first gemstones and a second base section for holding said plurality of second gemstones, said first and second base sections being substantially parallel to each other in a spacedapart relation, said posts extending along inner and outer edges of said base for securing said first gemstones and said second gemstones to said first and second base sections, respectively, and each of a plurality of said posts extends between two adjacent gemstones and is bent over in contact with said two adjacent gemstones for securing said two adjacent gemstones on a respective base section, wherein each post of said plurality of posts has a first end for securing two adjacent gemstones on said first base section and a second opposite end for securing two adjacent gemstones on said second base section.

10. A double face jewelry setting according to claim 9, wherein said posts are connected to said base and extend substantially perpendicular to said first and second sides of said base.

11. A double face jewelry setting according to claim 9, wherein said posts secure said first gemstones on said first side in substantial alignment with said second gemstones on said second side.

12. A double face jewelry setting according to claim 9, wherein said base is in the shape of a cross.

13. A double face jewelry setting according to claim 9, wherein said base is in the shape of a heart.

14. A double face jewelry setting according to claim 9, wherein said first base section includes a plurality of first bores for holding said plurality of first gemstones and said second base section includes a plurality of second bores for holding said plurality of second gemstones.

15. A double face jewelry setting according to claim 14, wherein at least one of said first and second bores has a configuration selected from the group consisting of a truncated frusto-conical configuration and a part-spherical configuration.

16. A double face jewelry setting according to claim 9, wherein said posts extend along inner and outer edges of said base for securing said first gemstones and said second gemstones to said first and second sides of said base, respectively, and each of a plurality of said posts extends between two adjacent gemstones and is bent over in contact with said two adjacent gemstones for securing said two adjacent gemstones on a respective side of said base.

* * * * *